US007736200B2

(12) United States Patent
Sproesser

(10) Patent No.: US 7,736,200 B2
(45) Date of Patent: Jun. 15, 2010

(54) BOOSTER CABLE CLAMP

(75) Inventor: George S. Sproesser, Leesport, PA (US)

(73) Assignee: East Penn Manufacturing Co., Inc., Lyon Station, PA (US)

( * ) Notice: Subject to any disclaimer, the term of this patent is extended or adjusted under 35 U.S.C. 154(b) by 0 days.

(21) Appl. No.: 12/401,417

(22) Filed: Mar. 10, 2009

(65) Prior Publication Data

US 2009/0233495 A1 Sep. 17, 2009

Related U.S. Application Data

(60) Provisional application No. 61/035,862, filed on Mar. 12, 2008.

(51) Int. Cl.
*H01R 4/28* (2006.01)

(52) U.S. Cl. ..... 439/754

(58) Field of Classification Search ..... 439/835, 439/754, 755, 829, 504, 769, 506
See application file for complete search history.

(56) References Cited

U.S. PATENT DOCUMENTS

| | | | | |
|---|---|---|---|---|
| 1,698,379 | A | 1/1929 | Taylor | |
| 4,449,772 | A * | 5/1984 | Johnson, III | 439/504 |
| 4,923,415 | A * | 5/1990 | Lee | 439/755 |
| 5,002,508 | A * | 3/1991 | Craveiro | 439/755 |
| 5,772,468 | A * | 6/1998 | Kowalski et al. | 439/506 |
| 6,896,544 | B1 | 5/2005 | Kuelbs et al. | |
| 2001/0012738 | A1 * | 8/2001 | Duperret et al. | 439/835 |

* cited by examiner

*Primary Examiner*—Briggitte R Hammond
(74) *Attorney, Agent, or Firm*—Barley Snyder LLC

(57) ABSTRACT

A booster cable clamp having an upper jaw and a lower jaw is disclosed. The upper jaw has an upper jaw left wall, an upper jaw right wall, and an upper jaw front wall while the lower jaw has a lower jaw left wall that substantially opposes the upper jaw left wall, a lower jaw right wall that substantially opposes the upper jaw right wall, and a lower jaw front wall that substantially opposes the upper jaw front wall. At least one of the upper jaw left wall, the upper jaw right wall, the upper jaw front wall, the lower jaw left wall, the lower jaw right wall, and the lower jaw front wall includes a substantially planar anvil contact surface.

10 Claims, 12 Drawing Sheets

BOOSTER CABLE CLAMP

CROSS-REFERENCE TO RELATED APPLICATIONS

This application claims the benefit of the filing date under 35 U.S.C. §119(a)-(d) of Provisional Patent Application No. 61/035,862, filed Mar. 12, 2008.

FIELD OF THE INVENTION

The present invention relates to the field of booster cable clamps, and specifically to a booster cable clamp having various jaw features.

BACKGROUND

Booster cables are used to jump start or boost an automobile which has a discharged battery. Generally, these booster cables consist of a pair of heavy wires, terminated in spring-loaded clamps, which either connect to battery terminals or grounded metal parts of the vehicle frame. They are readily available in varying lengths, sizes and shapes. More specifically, the clamps, or jaws, vary in construction, but are generally color-coded in order to prevent electrical short circuits. Most clamps, or jaws, are designed to fit both top- and side-mounted battery terminals and commonly vary in shape depending on battery terminal shape. Jaws can be made of copper, brass, steel or other electrically conductive material and may have plating applied such as copper, tin or zinc.

Clamps having clamping jaws adaptable to various battery terminal construction are well known. For instance, in Patent Application Publication No.: US 2001/0012738, a clamp for a battery jumper cable is disclosed having jaws with offset front sides, arc-shaped edges on one or more sides of the jaw, and insulating material surrounding both jaws to prevent the jaws of one clamp from contacting the jaws of another clamp when the clamps are in the closed position. As detailed, the edges of the jaws are shaped in various forms, in order to adapt to various battery constructions. For example, the left side is provided with traditional jagged shaped or teeth shaped profiles, while the right side is provided with an arc-shaped profile. The edge of the front side upper jaw and the edge of the front side lower jaw each have a shape that complements the other edge. While these edges do not have a traditional jagged or tooth shape, the two sides complement each other because the lower jaw is recessed in the shape of a V at an angle while the upper jaw is extended in the shape of a V at a slightly different angle to form an opening there between. Each side of the battery booster is specifically designed to properly attach with different battery terminal constructions. It should be further noted that for each of the jaws, contact with the battery terminal is made along opposing edges (thickness of the material) of each jaw.

Additionally, U.S. Pat. No. 4,923,415 discloses another well known jumper cable clamp for connection to car batteries. The described booster cable and clamps include an expansible conductive charging clip used to clip in the battery terminals which are set at the lateral side of the battery. The clamping jaw features a traditional opposed jagged edge clamping arrangement on each side, while the front end has a jagged edge jaw opposing a semicircular edged jaw. Additionally, the described clamp features a conductive charging clip, which is retractable within the jaws. It should also be noted here that each of the jaws contact the battery terminal along opposing edges along their thickness thereof.

A growing number of vehicles are being produced with remote charging studs, which become a third type of booster cable connection point, in addition to top post and lateral side post currently available. The third type of booster cable connection point is a result of manufacturers installing the battery in locations that are difficult, if not impossible, to access with booster cables. Currently, there are no existing booster cable sets that have been designed to accommodate the three battery terminal types. Such a booster cable clamp, having an improved ability to clamp the variety of battery terminal types, would be much needed.

SUMMARY

Accordingly, the present invention was devised in light of the long felt need described above, the invention relates to a booster cable clamp having an upper jaw and a lower jaw, where the lower jaw includes a lower jaw front wall having a substantially planar anvil contact surface among other clamp profiles.

In particular, the invention relates to a booster cable clamp having an upper jaw and a lower jaw. The upper jaw includes an upper jaw left wall, an upper jaw right wall, and an upper jaw front wall. The lower jaw includes a lower jaw left wall that substantially opposes the upper jaw left wall, a lower jaw right wall that substantially opposes the upper jaw right wall, and a lower jaw front wall that substantially opposes the upper jaw front wall. At least one of the upper jaw left wall, the upper jaw right wall, the upper jaw front wall, the lower jaw left wall, the lower jaw right wall, and the lower jaw front wall comprises a substantially planar anvil contact surface.

DETAILED DESCRIPTION OF THE EMBODIMENTS

Figure 1:
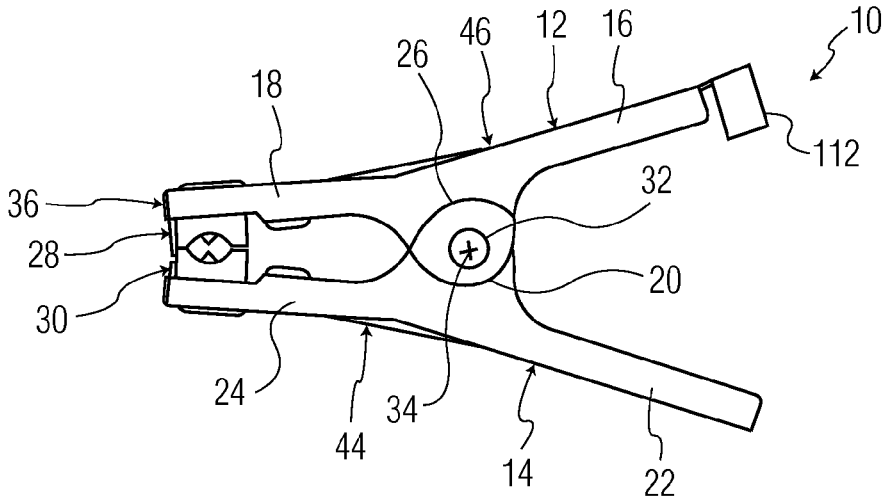
FIG. 1 is an orthogonal right side view of an embodiment of a clamp according to an embodiment of the present invention.
Figure 2:
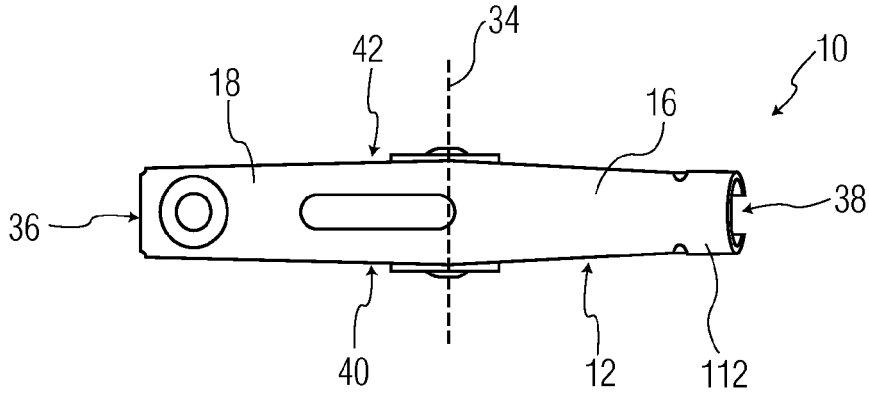
FIG. 2 is an orthogonal top view of the clamp of FIG. 1.
Figure 3:
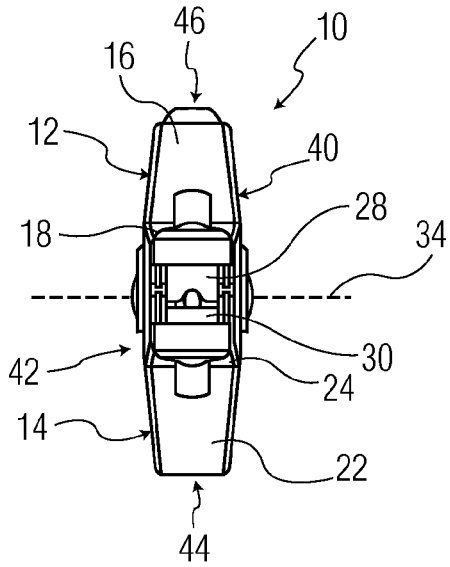
FIG. 3 is an orthogonal front view of the clamp of FIG. 1.
Figure 4:
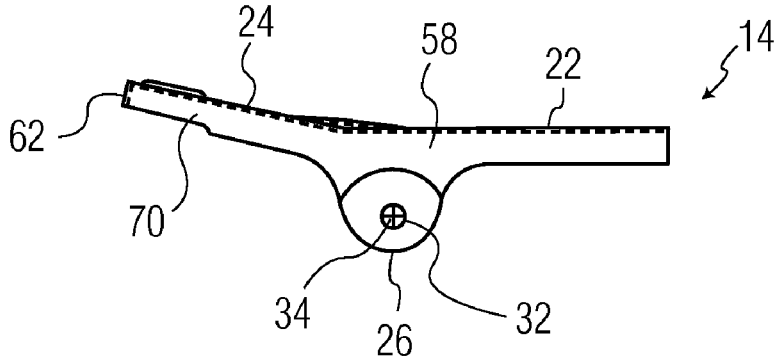
FIG. 4 is an orthogonal left side view of a lower clamp half of the clamp of FIG. 1.
Figure 5:
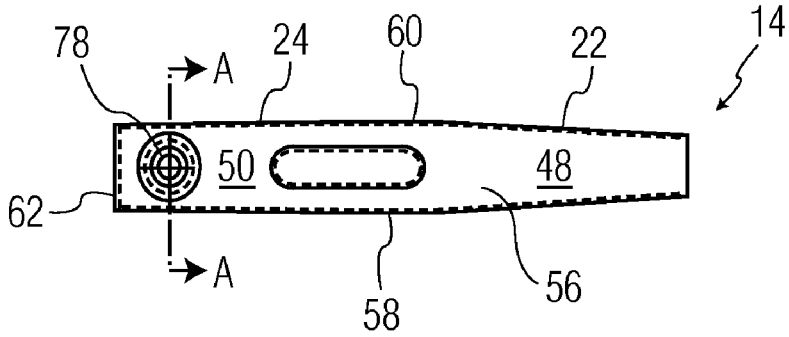
FIG. 5 is an orthogonal top view of the lower clamp half of FIG. 4.

Referring now to FIGS. 1-3, a clamp 10 according to the present invention is shown. The clamp 10 includes an upper clamp half 12 and a lower clamp half 14. The upper clamp half 12 having an upper handle 16 and an upper jaw support 18, with upper hinge mounts 20 located generally between the upper handle 16 and the upper jaw support 18 along a front-back length of the upper clamp half 12. The lower clamp half 14 having a lower handle 22 and a lower jaw support 24, with lower hinge mounts 26 located generally between the lower handle 22 and the lower jaw support 24 along the front-back length of the lower clamp half 14.

An upper jaw 28 is attached to the upper clamp half 12 on the upper jaw support 18, while a lower jaw 30 is attached to the lower clamp half 14 on the lower jaw support 24. Generally, the upper clamp half 12 and lower clamp half 14 are hinged together by the upper and lower hinge mounts 20, 26. More specifically, the upper clamp half 12 and lower clamp half 14 each includes shaft apertures 32 for receiving a shaft there through, pivotally connecting the two halves 12, 14. As explained in greater detail infra, the upper clamp half 12 and the lower clamp half 14 are biased with respect to each other so that the upper handle 16 and the lower handle 22 tend to rotate away from each other about an axis of rotation 34 that is generally coaxial with the shaft apertures 32. It follows that the upper jaw support 18 and the lower jaw support 24 are biased with respect to each other so that the upper jaw support 18 and the lower jaw support 24 tend to rotate toward each other about the same axis of rotation 34. Furthermore, the clamp 10 generally includes a front 36, a rear 38, a right side 40, a left side 42, a bottom 44, and a top 46, as is shown in FIG. 2. These directional notations will likewise serve for denoting directionality with respect to the component parts of the clamp 10 to be described infra.

With reference to FIGS. 4-9, the lower clamp half 14 is shown and now described, with the lower clamp half 14 having a lower handle outer surface 48 and a lower jaw support outer surface 50, as well as a lower handle inner surface 52 and a lower jaw support inner surface 54. As most clearly seen in FIGS. 4 and 8, the lower handle outer surface 48 and the lower jaw support outer surface 50 are not coplanar. It follows that the lower handle inner surface 52 and the lower jaw support inner surface 54 are also not coplanar. However, in an alternative embodiment, the lower handle outer surface 48 and the lower jaw support outer surface 50 may be coplanar. Similarly, in an alternative embodiment, the lower handle inner surface 52 and the lower jaw support inner surface 54 may be coplanar.

The lower handle outer surface 48, the lower handle inner surface 52, the lower jaw support outer surface 50, and the lower jaw support inner surface 54, in this embodiment, are each a surface or a portion of a surface of a lower clamp half central wall 56. The lower clamp half 14 further includes a lower clamp half left wall 58, a lower clamp half right wall 60, and a lower clamp half front wall 62. In the embodiment shown, the lower clamp half 14 may be formed from a single sheet or plate of material, whereby the material is stamped or cut into a predetermined form. Subsequently, the predetermined form is bent or otherwise manipulated to cause the lower clamp half left wall 58, the lower clamp half right wall 60, and the lower clamp half front wall 62, extending away from the lower clamp half central wall 56 beyond the lower handle inner surface 52 and/or the lower jaw support inner surface 54.

Figure 6:
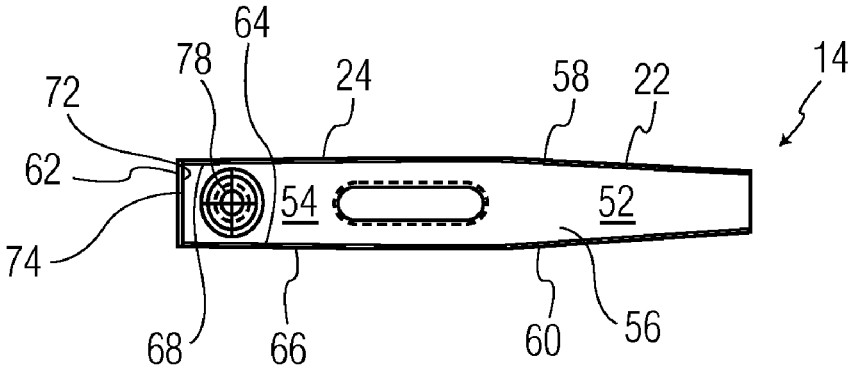
FIG. 6 is an orthogonal bottom view of the lower clamp half of FIG. 4.
Figure 7:
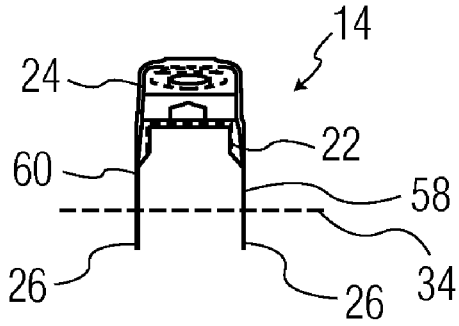
FIG. 7 is an orthogonal front view of the lower clamp half of FIG. 4.
Figure 8:
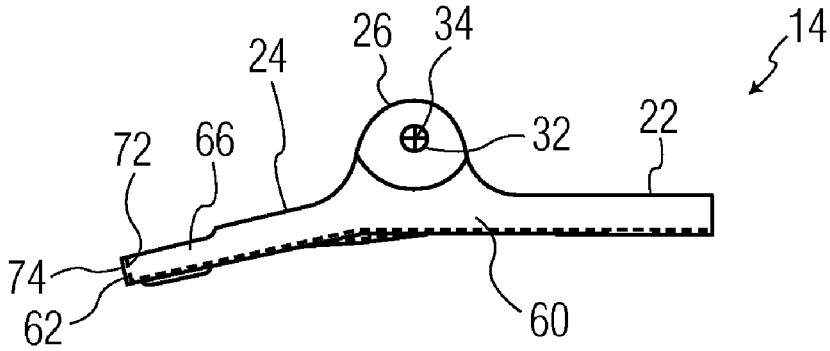
FIG. 8 is an orthogonal right side view of the lower clamp half of FIG. 4.
Figure 9:
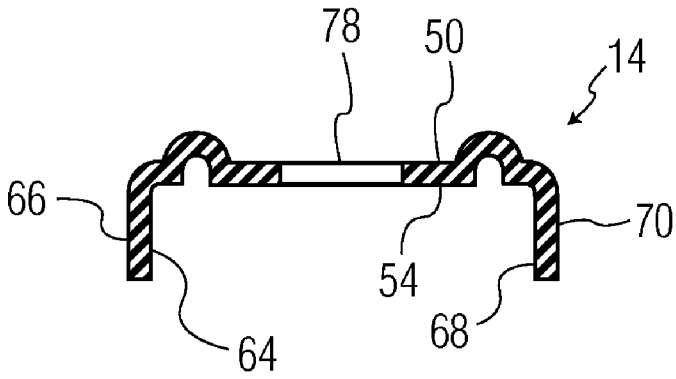
FIG. 9 is a cross-sectional view taken at cutting line A-A of FIG. 5 of the lower clamp half.
Figure 10:
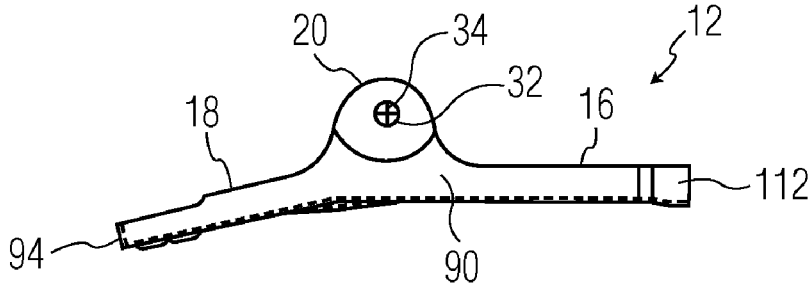
FIG. 10 is an orthogonal left side view of an upper clamp half of the clamp of FIG. 1.
Figure 11:
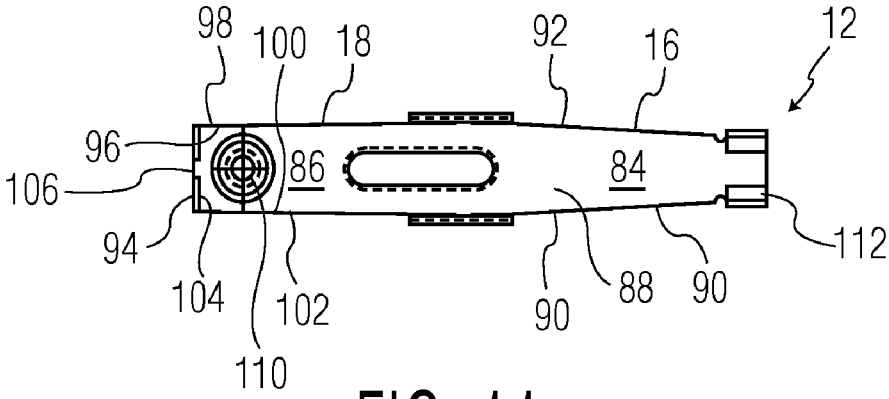
FIG. 11 is an orthogonal bottom view of the upper clamp half of FIG. 10.
Figure 12:
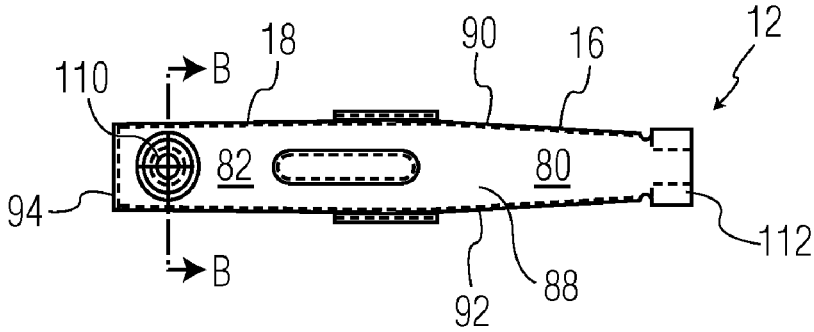
FIG. 12 is an orthogonal top view of the upper clamp half of FIG. 10.
Figure 13:
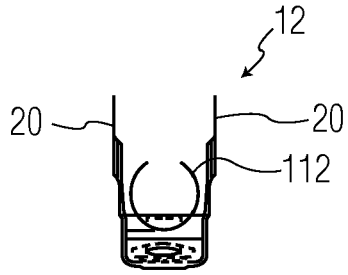
FIG. 13 is an orthogonal rear view of the upper clamp half of FIG. 10.
Figure 14:
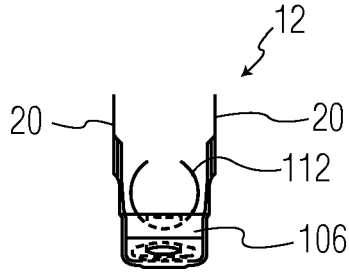
FIG. 14 is an orthogonal front view of the upper clamp half of FIG. 10.
Figure 15:
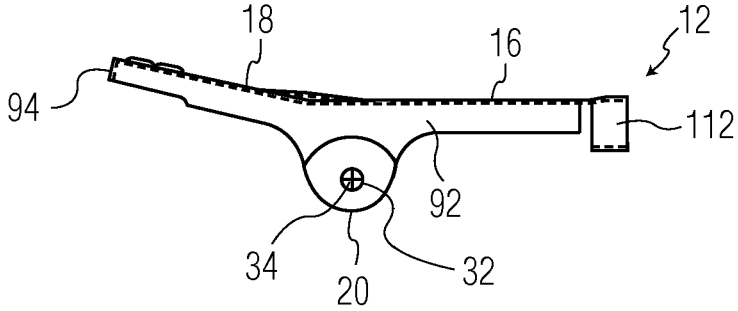
FIG. 15 is an orthogonal right side view of the upper clamp half of FIG. 10.
Figure 16:
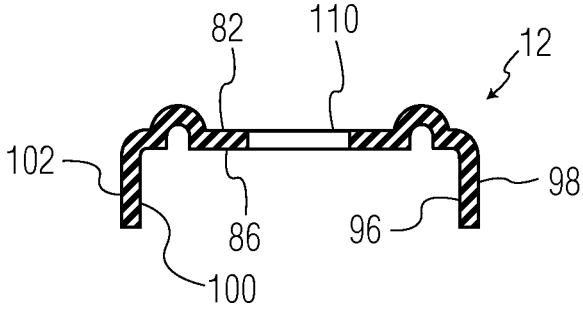
FIG. 16 is a cross-sectional view taken at cutting line B-B of FIG. 12 of the upper clamp half.
Figure 17:
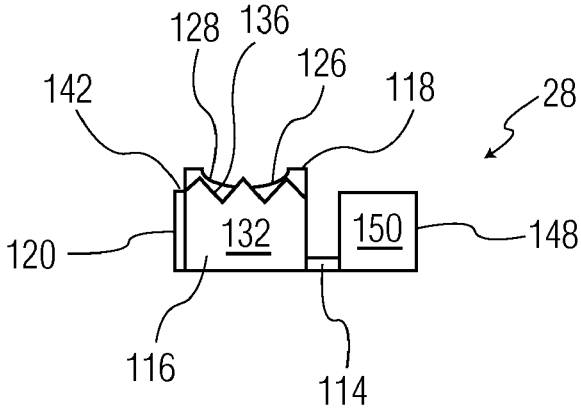
FIG. 17 is an orthogonal left side view of an upper jaw of the clamp of FIG. 1.
Figure 18:
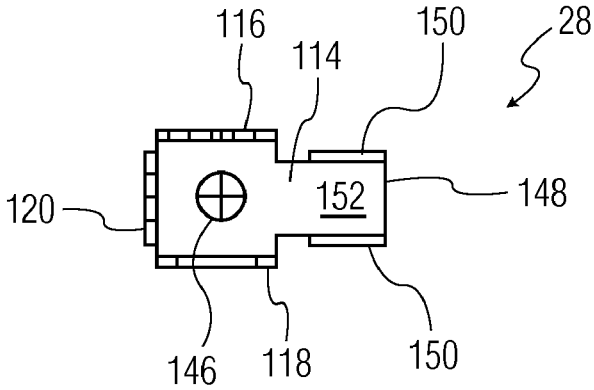
FIG. 18 is an orthogonal top view of the upper jaw of FIG. 17.
Figure 19:
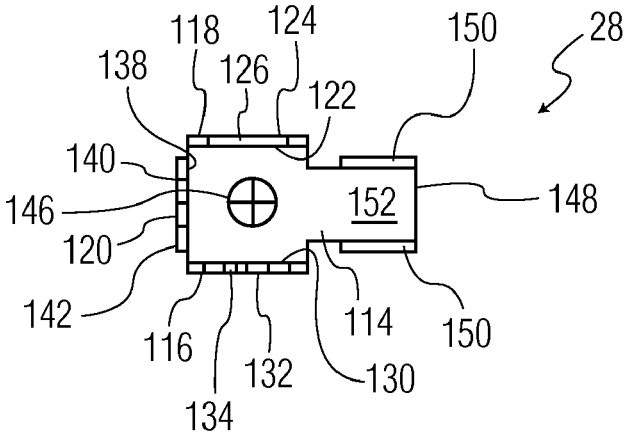
FIG. 19 is an orthogonal bottom view of the upper jaw of FIG. 17.
Figure 20:
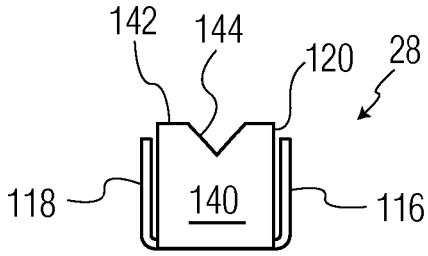
FIG. 20 is an orthogonal front view of the upper jaw of FIG. 17.
Figure 21:
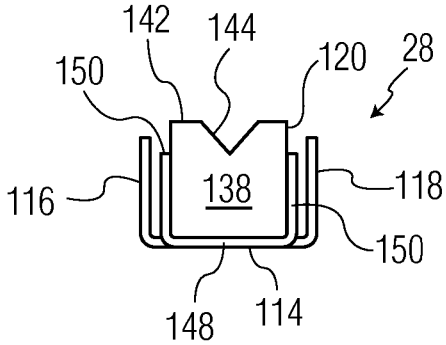
FIG. 21 is an orthogonal rear view of the upper jaw of FIG. 17.
Figure 22:
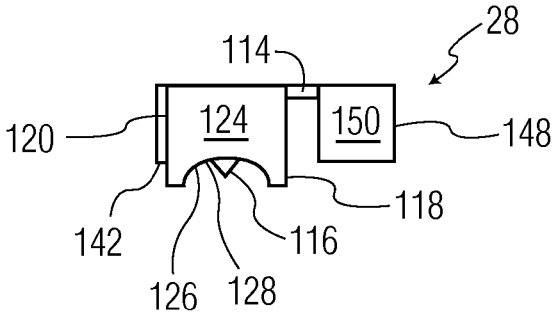
FIG. 22 is an orthogonal right side view of the upper jaw of FIG. 17.
Figure 23:
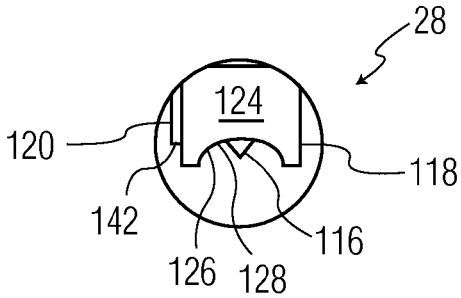
FIG. 23 is an enlarged detail view of a portion of FIG. 22.
Figure 24:
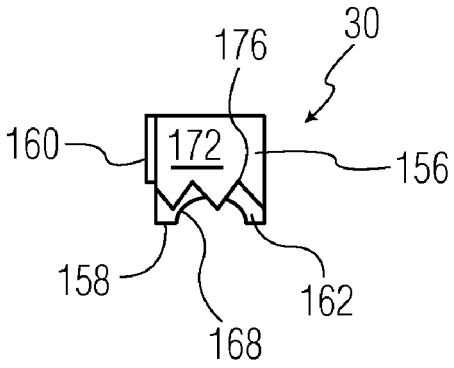
FIG. 24 is an orthogonal left side view of a lower jaw of the clamp of FIG. 1.
Figure 25:
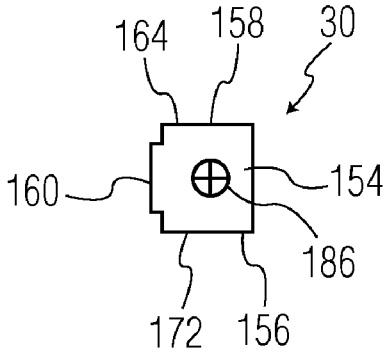
FIG. 25 is an orthogonal bottom view of the lower jaw of FIG. 24.
Figure 26:
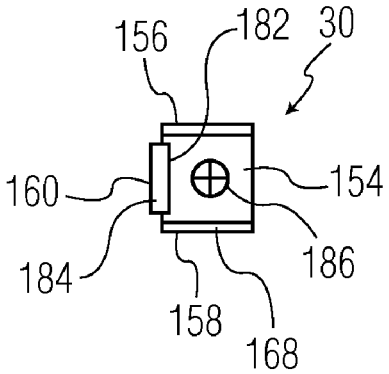
FIG. 26 is an orthogonal top view of the lower jaw of FIG. 24.
Figure 27:
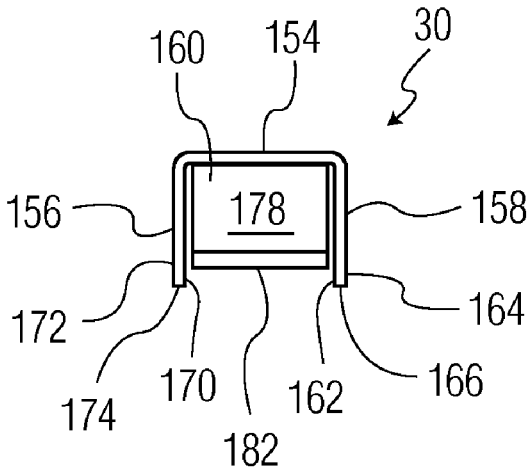
FIG. 27 is an orthogonal rear view of the lower jaw of FIG. 24.
Figure 28:
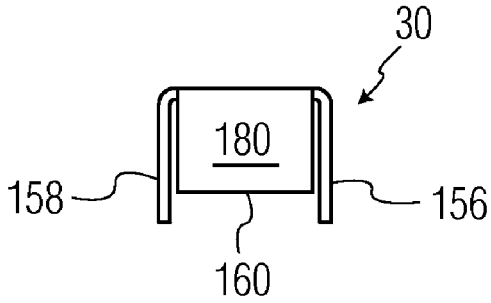
FIG. 28 is an orthogonal front view of the lower jaw of FIG. 24.
Figure 29:
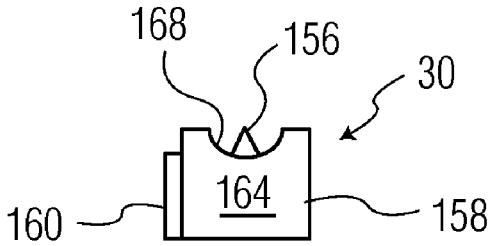
FIG. 29 is an orthogonal right side view of the lower jaw of FIG. 24.

Referring now to FIGS. 6 and 9, the lower clamp half right wall 60 will be specifically shown, having a lower clamp half right wall inner surface 64 and a lower clamp half right wall outer surface 66. Similarly, the lower clamp half left wall 58 includes a lower clamp half left wall inner surface 68 and a lower clamp half left wall outer surface 70. In addition, the lower clamp half front wall 62 includes a lower clamp half front wall inner surface 72 and a lower clamp half front wall outer surface 74. Collectively, the lower jaw support inner surface 54, the lower clamp half right wall inner surface 64, the lower clamp half left wall inner surface 68, and the lower clamp half front wall inner surface 72 partially bound a lower jaw receiving space that receives at least a portion of the lower jaw 30. In the embodiment shown, the lower clamp half central wall 56 includes a lower jaw mounting aperture 78 into/through which a fastener (not shown) is received in order to attach the lower jaw 30 to the lower jaw support 24.

In the embodiment shown, at least a portion of the lower clamp half 14 is vinyl coated in order to provide insulative and/or corrosion resistant properties. However, it will be appreciated that in other embodiments, any other suitable insulative and/or corrosion resistant coatings may be applied to the lower clamp half 14.

With reference to FIGS. 10-16, the upper clamp half 12 is now described. The upper clamp half 12 is shown having an upper handle outer surface 80 and an upper jaw support outer surface 82, as well as an upper handle inner surface 84 and an upper jaw support inner surface 86. As most clearly seen in FIGS. 10 and 15, the upper handle outer surface 80 and the upper jaw support outer surface 82 are not coplanar. Furthermore, the upper handle inner surface 84 and the upper jaw support inner surface 86 are also not coplanar. However, in an alternative embodiments, the upper handle outer surface 80 and the upper jaw support outer surface 82 may be coplanar. Similarly, in alternative embodiments, the upper handle inner surface 84 and the upper jaw support inner surface 86 may be coplanar as well.

The upper handle outer surface 80, the upper handle inner surface 84, the upper jaw support outer surface 82, and the upper jaw support inner surface 86, in this embodiment, are each a surface or a portion of a surface of an upper clamp half central wall 88. The upper clamp half 12 also has an upper clamp half left wall 90, an upper clamp half right wall 92, and an upper clamp half front wall 94. In the embodiment shown, the upper clamp half 12 may be formed from a single sheet or plate of material, whereby the material is stamped or cut into a predetermined form. Subsequently, the predetermined form is bent or otherwise manipulated to cause the upper clamp half left wall 90, the upper clamp half right wall 92, and the upper clamp half front wall 94 to extend away from the upper clamp half central wall 88 beyond the upper handle inner surface 84 and/or the upper jaw support inner surface 86. The upper clamp half right wall 92 includes an upper clamp half right wall inner surface 96 and an upper clamp half right wall outer surface 98. Similarly, the upper clamp half left wall 90 includes an upper clamp half left wall inner surface 100 and an upper clamp half left wall outer surface 102. Finally, the upper clamp half front wall 94 includes an upper clamp half front wall inner surface 104 and an upper clamp half front wall outer surface 106. Collectively, the upper jaw support inner surface 86, the upper clamp half right wall inner surface 96, the upper clamp half left wall inner surface 100, and the upper clamp half front wall inner surface 104 partially bound an upper jaw receiving space that receives at least a portion of the upper jaw 28.

In the embodiment shown, the upper clamp half central wall 88 includes an upper jaw mounting aperture 110 into/through which a fastener (not shown) is received to attach the upper jaw 28 to the upper jaw support 18. The upper clamp half 12 further comprises a cable grip 112 near the rear of the upper clamp half 12 and extending from the upper handle 16. The cable grip 112, in this embodiment is provided as a tubular ring having a notch along the length of the tube. The cable grip 112 may be crimped or otherwise deformed to retain a cable or wire within the interior of the tube. In this embodiment, at least a portion of the upper clamp half 12 is vinyl coated. However, it will be appreciated that in other embodiments, any other suitable insulative and/or corrosion resistant coatings may be applied to the upper clamp half 12.

Referring now to FIGS. 17-23, the upper jaw 28 is shown, with the upper jaw 28 having an upper jaw central wall 114. An upper jaw left wall 116, an upper jaw right wall 118, and an upper jaw front wall 120 extend from the upper jaw central wall 114.

The upper jaw right wall 118 includes an upper jaw right wall inner surface 122 facing the left side 42 of the clamp 10, an upper jaw right wall outer surface 124 facing the right side 40 of the clamp 10, and an upper jaw right wall contact surface 126 facing the bottom 44 of the clamp 10. The upper jaw right wall 118 further includes an upper jaw right wall recess 128 that, in the embodiment shown, is formed as an arcuate cutout extending from the upper jaw right wall inner surface 122 to the upper jaw right wall outer surface 124. The upper jaw right wall recess 128 at least partially defines the upper jaw right wall contact surface 126.

The upper jaw left wall 116 includes an upper jaw left wall inner surface 130 facing the right side 40 of the clamp 10, an upper jaw left wall outer surface 132 facing the left side 42 of the clamp 10, and an upper jaw left wall contact surface 134 facing the bottom 44 of the clamp 10. The upper jaw left wall 116 further includes upper jaw left wall recesses 136 that, and in the embodiment shown, are formed as V-shaped cutouts extending from the upper jaw left wall inner surface 130 to the upper jaw left wall outer surface 132. The upper jaw left wall recesses 136, at least partially, define the upper jaw left wall contact surface 134. The upper jaw front wall 120 includes an upper jaw front wall inner surface 138 facing the rear 38 of the clamp 10, an upper jaw front wall outer surface 140 facing the front 36 of the clamp 10, and an upper jaw front wall contact surface 142 facing the bottom 44 of the clamp 10.

The upper jaw front wall 120 further includes an upper jaw front wall recess 144 that, in the embodiment shown, is formed as single V-shaped cutout extending from the upper jaw front wall inner surface 138 to the upper jaw front wall outer surface 140. In the embodiment shown, the upper jaw front wall recess 144 is substantially centered on the upper jaw front wall 120 between the upper jaw left wall 116 and the upper jaw right wall 118. The upper jaw front wall recess 144, at least partially, defines the upper jaw front wall contact surface 142, with the upper jaw 28 further having an upper jaw mount hole 146, an axis of which is generally coaxial with an axis of the upper jaw mounting aperture 110. The upper jaw mount hole 146, into/through which a fastener (not shown) is received to attach the upper jaw 28 to the upper jaw support 18, is formed in the upper jaw central wall 114. The upper jaw 28 further includes an upper jaw conductor grip 148 near the rear of the upper jaw 28 and extending from the upper jaw central wall 114. The upper jaw conductor grip 148, in the embodiment shown, is provided as a pair of upstanding upper jaw grip walls 150 connected to an upper jaw grip base 152. The upper jaw grip walls 150 and the upper jaw grip base 152 may be crimped or otherwise deformed to retain a conductor or wire.

In the embodiment shown, the upper jaw 28 may be formed from a single sheet or plate of material whereby the material is stamped or cut into a predetermined form. Subsequently, the predetermined form is bent or otherwise manipulated to cause the upper jaw left wall 116, the upper jaw right wall 118, and the upper jaw front wall 120 to extend away from the upper jaw central wall 114. In this embodiment, the upper jaw 28 is constructed of copper plated heavy gauge steel. However, it will be appreciated that in other embodiments of the present invention, the upper jaw 28 may be constructed of any other suitable conductive material.

With reference now to FIGS. 24-29, the lower jaw 30 is described. The lower jaw 30, as shown, includes a lower jaw central wall 154, with a lower jaw left wall 156, a lower jaw right wall 158, and a lower jaw front wall 160 extending from the lower jaw central wall 154.

The lower jaw right wall 158 includes a lower jaw right wall inner surface 162 facing the left side 42 of the clamp 10, a lower jaw right wall outer surface 164 facing the right side 40 of the clamp 10, and a lower jaw right wall contact surface 166 facing the top 46 of the clamp 10. The lower jaw right wall 158 further includes a lower jaw right wall recess 168 that, in the embodiment shown, is formed as an arcuate cutout extending from the lower jaw right wall inner surface 162 to the lower jaw right wall outer surface 164. The lower jaw right wall recess 168 at least partially defines the lower jaw right wall contact surface 166.

The lower jaw left wall 156 includes a lower jaw left wall inner surface 170 facing the right side 40 of the clamp 10, a lower jaw left wall outer surface 172 facing the left side 42 of the clamp 10, and a lower jaw left wall contact surface 174 facing the top 46 of the clamp 10. The lower jaw left wall 156 further includes lower jaw left wall recesses 176 that, in the embodiment shown, are formed as V-shaped cutouts extending from the lower jaw left wall inner surface 170 to the lower jaw left wall outer surface 172. The lower jaw left wall recesses 176, at least partially, define the lower jaw left wall contact surface 174.

The lower jaw front wall 160 includes a lower jaw front wall inner surface 178 facing the rear 38 of the clamp 10, a lower jaw front wall outer surface 180 facing the front 36 of the clamp 10, and a lower jaw front wall anvil 182. The lower jaw front wall anvil 182, in the embodiment shown, extends rearward toward the rear 38 of the clamp 10. The lower jaw front wall anvil 182 includes a lower jaw anvil contact surface 184 that faces the top 46 of the clamp 10, and the lower jaw 30 further includes a lower jaw mount hole 186, which is an axis of which is generally coaxial with an axis of the lower jaw mounting aperture 78. The lower jaw mount hole 186, into/through which a fastener (not shown) is received to attach the lower jaw 30 to the lower jaw support 24, is formed in the lower jaw central wall 154.

In the embodiment, the lower jaw 30 may be formed from a single sheet or plate of material, whereby the material is stamped or cut into a predetermined form. Subsequently, the predetermined form is bent or otherwise manipulated to cause the lower jaw left wall 156, the lower jaw right wall 158, and the lower jaw front wall 160 to extend away from the lower jaw central wall 154. In this embodiment, the lower jaw 30 is constructed of copper plated heavy gauge steel. However, it will be appreciated that in other embodiments of the present invention, the lower jaw 30 may be constructed of any other suitable conductive material.

Figure 30:
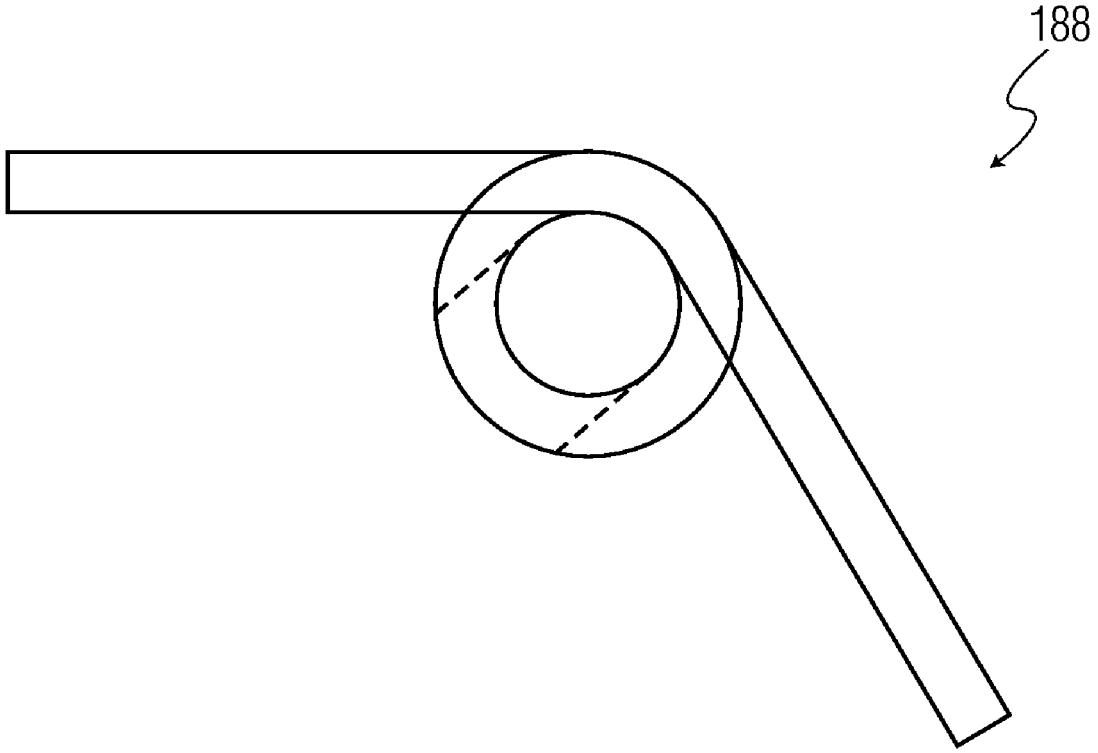
FIG. 30 is an orthogonal view of a spring of the clamp of FIG. 1.
Figure 31:
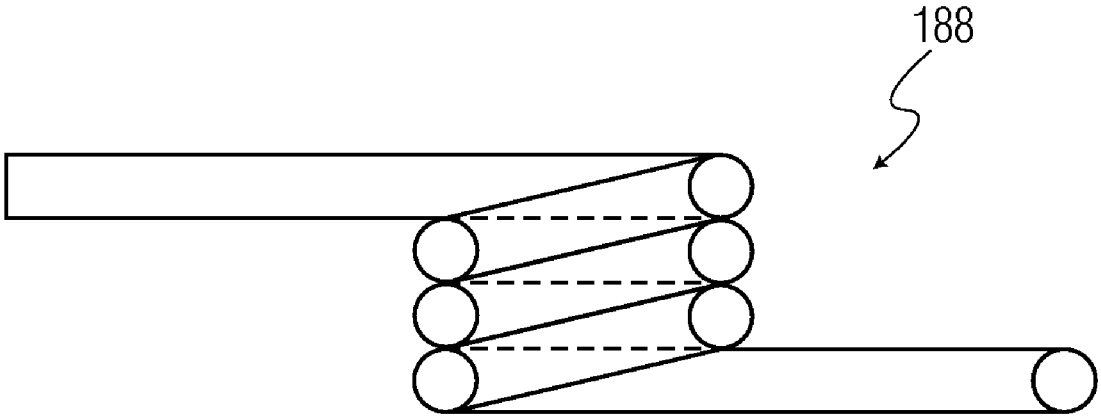
FIG. 31 is another orthogonal view of the spring of FIG. 30.

Referring now to FIGS. 30 and 31, a spring 188 is shown, with the spring 188 used in biasing the upper clamp half 12 with respect to the lower clamp half 14. The axis of the generally coiled portion of the spring 188 may be disposed to be substantially coaxial with the axis of rotation 34. Furthermore, the legs of the spring 188 may be disposed so one leg presses on the lower handle inner surface 52, while the remaining leg of the spring 188 presses on the upper handle inner surface 84.

Figure 32:
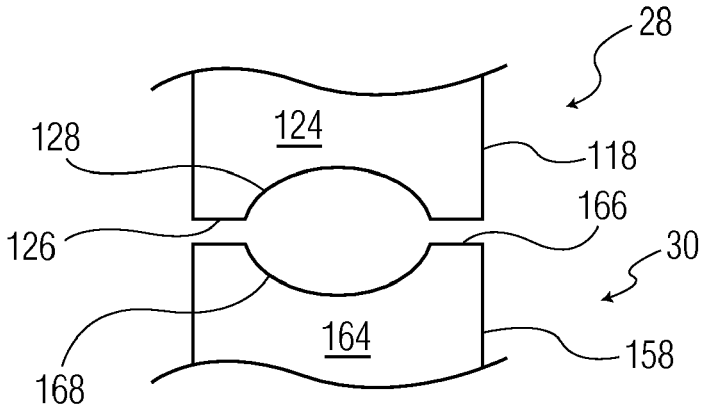
FIG. 32 is an orthogonal right side partial view of the upper jaw of FIG. 17 and the lower jaw of FIG. 24.

With reference now to FIG. 32, the upper jaw right wall 118 and lower jaw right wall 158 are shown in close proximity to each other and aligned substantially as if the clamp 10 were fully assembled, and in a resting fully biased position (or a closed position). As is clearly shown, a battery terminal post may be received between the upper jaw right wall 118 and lower jaw right wall 158, or optionally in a space between the upper jaw right wall recess 128 and the lower jaw right wall recess 168.

Figure 33:
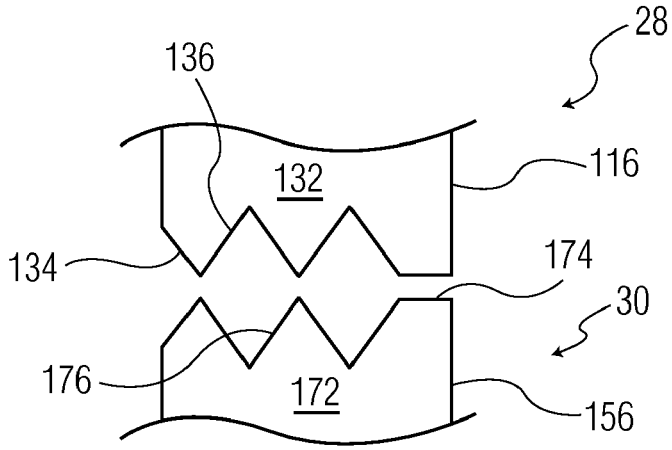
FIG. 33 is an orthogonal left side partial view of the upper jaw of FIG. 17 and the lower jaw of FIG. 24.

Referring now to FIG. 33, the upper jaw left wall 116 and lower jaw left wall 156 are shown in close proximity to each other and aligned substantially as if the clamp 10 were fully assembled and in a resting fully biased position (or a closed position). It is clear that a battery terminal post may be received between the upper jaw left wall 116 and lower jaw left wall 156, or optionally in a space between an upper jaw left wall recess 136, and a corresponding lower jaw left wall recess 176.

Figure 34:
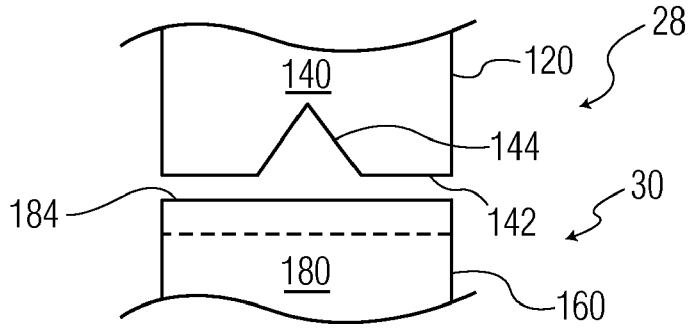
FIG. 34 is an orthogonal front partial view of the upper jaw of FIG. 17 and the lower jaw of FIG. 24.
Figure 35:
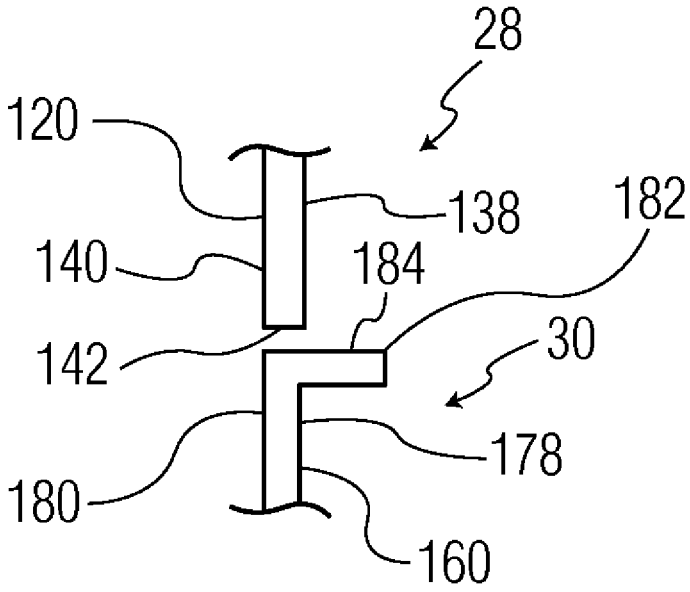
FIG. 35 is an orthogonal right side partial view of the upper jaw of FIG. 17 and the lower jaw of FIG. 24.

Referring now to FIGS. 34 and 35, the upper jaw front wall 120 and lower jaw front wall 160 are shown in close proximity to each other and aligned substantially as if the clamp 10 were fully assembled and in a resting fully biased position (or a closed position). It is clear that a battery terminal post may be received between the upper jaw front wall 120 and the lower jaw front wall 160, or optionally in a space between the upper jaw front wall recess 144 and the lower jaw front wall anvil 182.

It is clearly shown, that the lower jaw front wall anvil 182 is generally integral to the lower jaw front wall 160 and is a rearwardly bent portion of the lower jaw front wall 160. The lower jaw front wall anvil 182 provides the lower jaw anvil contact surface 184 to engage a battery terminal in combination with the upper jaw front wall contact surface 142.

Figure 36:
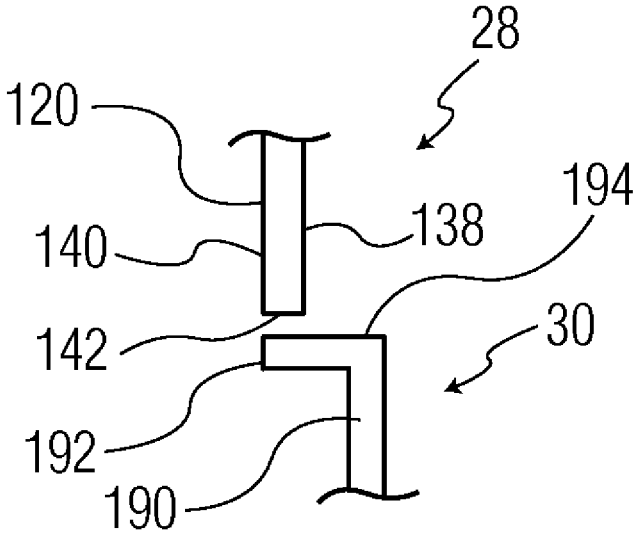
FIG. 36 is an orthogonal right side partial view of the upper jaw of FIG. 17 and a lower jaw according to an alternative embodiment of the present invention.

With reference to FIG. 36, the upper jaw front wall 120 is shown in close proximity to an alternative embodiment of a lower jaw front wall. Specifically, lower jaw front wall 190 includes a lower jaw front wall anvil 192 that, unlike lower jaw front wall anvil 182, is bent from the lower jaw front wall 190 toward the front 36 of the clamp 10. The lower jaw front wall anvil 192 also provides a lower jaw anvil contact surface 194. The lower jaw anvil contact surface 194, in cooperation with the upper jaw front wall contact surface 142, may engage a battery terminal.

Referring again to FIGS. 1-3, it is clear that when the clamp 10 is fully assembled, the upper jaw 28 is carried by the upper jaw support 18 and that the lower jaw 30 is carried by the lower jaw support 24. Specifically, the upper jaw 28 is secured to the upper jaw support 18 so that the upper jaw central wall 114 is generally abutted against and/or adjacent to the upper jaw support inner surface 86 and at least partially within the upper jaw receiving space. Furthermore, the upper jaw front wall outer surface 140 is substantially adjacent to and faces the upper clamp half front wall inner surface 104. Similarly, the lower jaw 30 is secured to the lower jaw support 24 so that the lower jaw central wall 154 is generally abutted against and/or adjacent to the lower jaw support inner surface 54 and at least partially within the lower jaw receiving space. The lower jaw front wall outer surface 180 is substantially adjacent to and faces the lower clamp half front wall inner surface 72.

It will be appreciated that the present invention is not limited to the specific embodiment enumerated herein. Specifically, it will be appreciated that the present invention includes the rearranging of the physical features of the upper jaw 28 and lower jaw 30 so that the differently shaped recesses carried on the various walls of the upper jaw 28 and the lower jaw 30 may be located on different walls. For example, the recess of the left side walls may instead be located on the right side walls. Alternatively, the structures of the front walls may instead be located on the left or right side walls. Further, alternative embodiments may have differently shaped recesses from those specifically depicted.

What is claimed is:

1. A booster cable clamp, comprising:

an upper jaw comprising an upper jaw left wall, an upper jaw right wall, and an upper jaw front wall; and a lower jaw comprising a lower jaw left wall substantially opposing the upper jaw left wall, a lower jaw right wall substantially opposing the upper jaw right wall, and a lower jaw front wall substantially opposing the upper jaw front wall;

wherein at least one of the lower jaw front wall comprises a substantially planar anvil contact surface bent rearwardly or forwardly from the lower jaw and substantially orthogonal to a planar surface of the lower and upper jaws.

2. The booster cable clamp according to claim 1, wherein at least one of the upper jaw left wall, the upper jaw right wall, the upper jaw front wall, the lower jaw left wall, the lower jaw right wall, and the lower jaw front wall that opposes the anvil contact surface comprises a V-shaped recess.

3. The booster cable clamp according to claim 1, wherein the anvil contact surface extends toward a rear of the booster cable clamp from the lower jaw front wall.

4. The booster cable clamp according to claim 1:

wherein the upper jaw front wall comprises a V-shaped recess recessed in a direction substantially orthogonal to the anvil contact surface;

wherein the lower jaw front wall comprises the anvil contact surface;

wherein the upper jaw left wall comprises a plurality of V-shaped recesses;

wherein the lower jaw left wall comprises a plurality of V-shaped recesses;

wherein the upper jaw right wall comprises an arcuate recess; and wherein the lower jaw right wall comprises an arcuate recess.

5. The booster cable clamp according to claim 1, wherein the anvil contact surface is integral to and the lower jaw front wall.

6. The booster cable clamp according to claim 1, wherein at least one of the upper jaw and the lower jaw is constructed of copper plated steel.

7. The booster cable clamp according to claim 2, wherein the V-shaped recess is recessed in a direction substantially orthogonal to the anvil contact surface.

8. The booster cable clamp according to claim 1, wherein at least one of the upper jaw left wall, the upper jaw right wall, the upper jaw front wall, the lower jaw left wall, the lower jaw right wall, and the lower jaw front wall that opposes the anvil contact surface comprises a single recess substantially centered between a left side of the booster cable clamp and a right side of the booster cable clamp.

9. The booster cable clamp according to claim 1, the lower jaw further comprising:

a lower jaw central wall connected to each of the lower jaw front wall, the lower jaw left wall, and the lower jaw right wall.

10. The booster cable clamp according to claim 9, wherein the lower jaw central wall is disposed substantially orthogonally to each of the lower jaw front wall, the lower jaw left wall, and the lower jaw right wall.

* * * * *